US005417635A

United States Patent [19]

Sell

[11] Patent Number: 5,417,635

[45] Date of Patent: May 23, 1995

[54] HEAVENLY WEIGHTWALKING EXERCISE APPARATUS

[76] Inventor: Blaine W. Sell, 1514 Alpine Rd. Apartment Eight, Grand Rapids, Mich. 49504

[21] Appl. No.: 133,859

[22] Filed: Oct. 12, 1993

[51] Int. Cl.[6] ..... H63B 21/065

[52] U.S. Cl. ..... 482/105; 482/93; 482/148

[58] Field of Search ..... 206/315.1; 190/115, 190/117; 150/107; 338/13, 26; 482/105–108, 148, 98, 74, 93

[56] References Cited

U.S. PATENT DOCUMENTS

| | | | |
|---|---|---|---|
| 1,577,077 | 3/1926 | Ray | 482/105 |
| 2,487,145 | 11/1944 | Kohlman | 383/13 |
| 3,910,577 | 10/1975 | Boyle | 482/105 |
| 3,955,728 | 5/1976 | Jackson et al. | 383/13 |
| 4,223,819 | 9/1980 | Wright | 190/115 |
| 4,332,379 | 6/1982 | Bannister | 482/105 |
| 4,643,302 | 2/1987 | Baumgardner | 190/119 |
| 4,759,431 | 7/1988 | King et al. | 190/115 |
| 4,799,521 | 1/1989 | Shick | 190/115 |
| 4,966,259 | 10/1990 | Bergman | 190/115 |
| 5,085,320 | 2/1992 | Scott | 150/107 |

FOREIGN PATENT DOCUMENTS

| | | | |
|---|---|---|---|
| 1215614 | 4/1960 | France | 383/26 |

*Primary Examiner*—Richard J. Apley
*Assistant Examiner*—Jerome Donnelly
*Attorney, Agent, or Firm*—Waters & Morse

[57] ABSTRACT

A device for building muscle while walking. A weight bag and shoulder bag form a unit which may be filled with varying amounts of weights and carried over a user's shoulder and upper back allowing the user complete mobility while building muscle.

6 Claims, 2 Drawing Sheets

HEAVENLY WEIGHTWALKING EXERCISE APPARATUS

BACKGROUND OF THE INVENTION

This invention comprises a device for muscle building exercise. The use of exercise devices to build muscle is a well-known practice. In the past, the primary devices used for muscle building exercise were stationary weight machines, free weights, hand held weights and more recently, attachable wrist and ankle weights. Stationary machines and free weights provide for the use of a wide range of different weight combinations allowing the user to personalize the amount of weight used to build muscle. However, both the machines and the free weights are cumbersome and do not allow the user mobility since the devices must be used indoors.

Hand-held weights and attachable wrist and ankle weights provide mobility to the user and may be used while walking. However, these mobile muscle building devices do not provide for the use of a wide range of weight combinations or for the use of the sufficient amounts of weight needed for substantial muscle building that is available with the immobile muscle building devices. A muscle building weight apparatus which provides the vary with the ability to use a wide range of weight combinations, allows the user the ability to user the amount of weight needed for substantial muscle building, and allows the user to be mobile would be useful and desirable to those who use exercise equipment to build muscle.

SUMMARY OF THE INVENTION

This invention comprises a device for mobile weight lifting exercise. The device includes an openable weight bag in which individual weights can be inserted and removed as desired by a user. The weight bag fastens to a shoulder bag which extends outwardly from the weight bag and is carried across the upper part of the user's back, allowing the user freedom from cumbersome weight machines and mobility to move about as desired while building muscle.

DESCRIPTION OF THE PREFERRED EMBODIMENT

Figure 1:
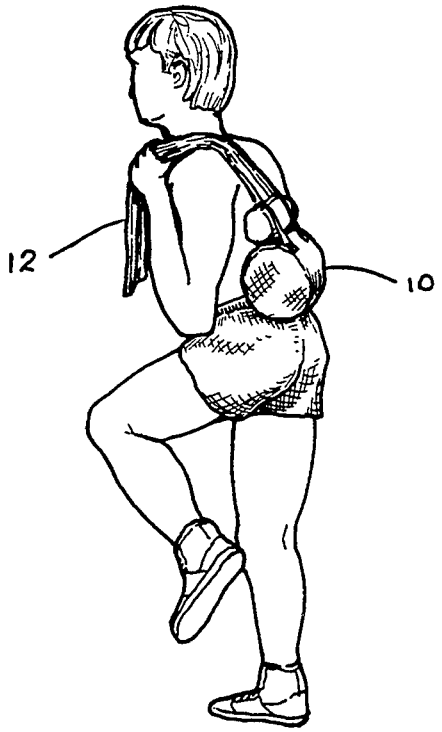
FIG. 1 is a pictorial view showing the use of the weight bag in an exercise program.
Figure 2:
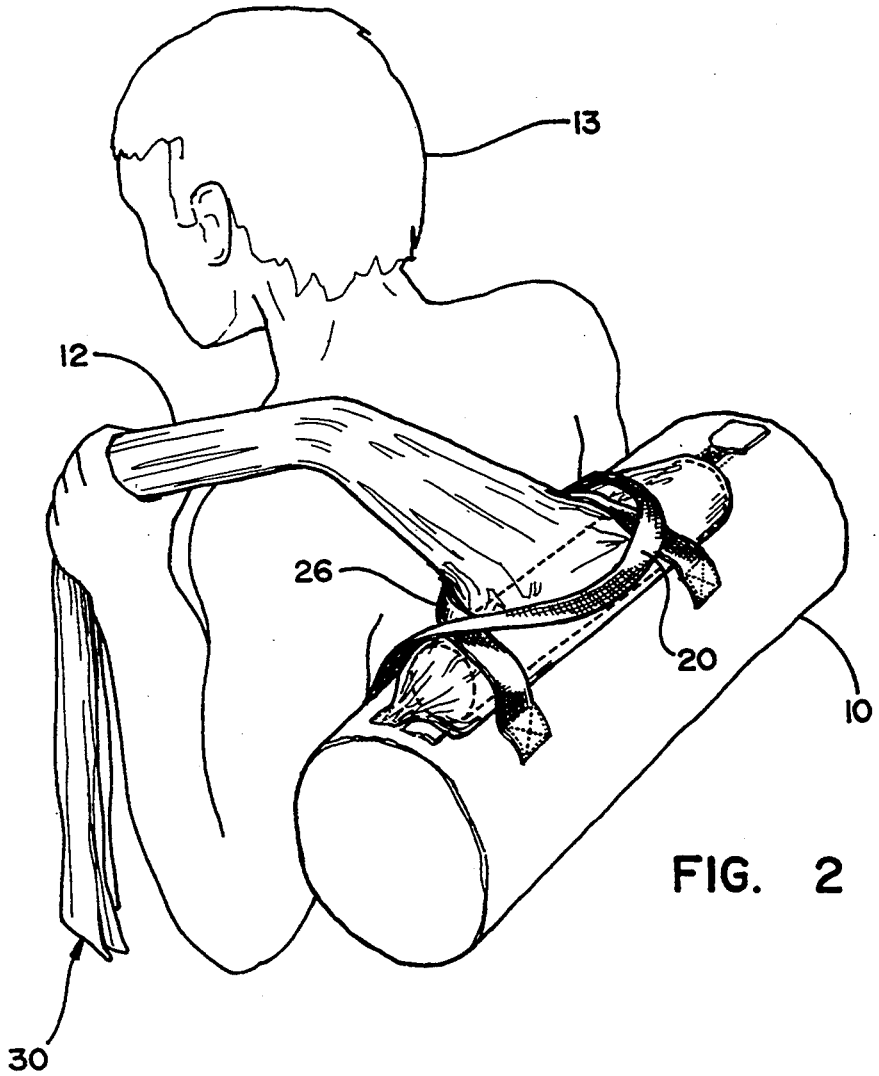
FIG. 2 is a perspective view showing the weight bag and the shoulder bag positioned over the shoulder of the user.

Referring to FIG. 2 of the drawings, an openable weight bag 10 is attached to a flexible shoulder bag 12 and placed over the shoulder of a user 13. The weight bag hangs by the shoulder bag over the back of the user's shoulder and rests on the upper back of the user allowing the user mobility. The user holds the shoulder bag in place by hand.

Figure 3:
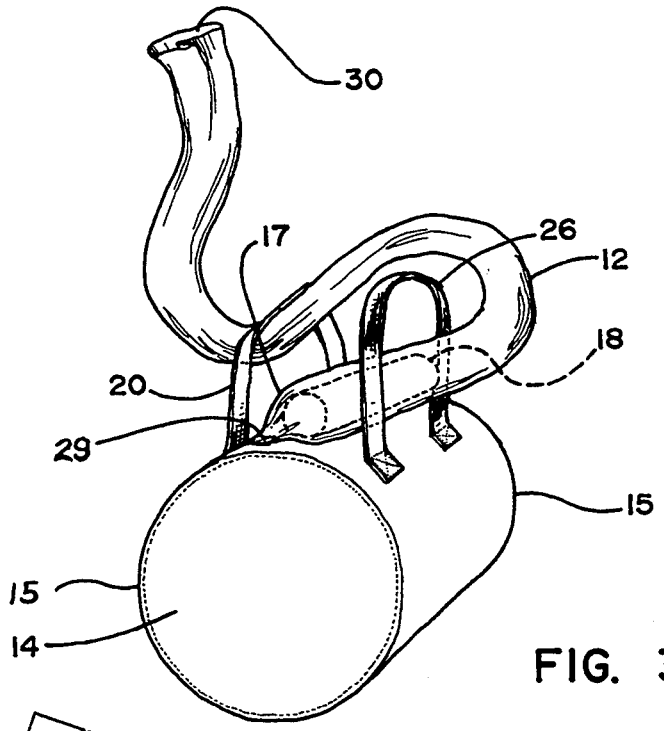
FIG. 3 is a perspective view of the weight bag showing the shoulder bag looped through the weight bag handles.

The weight bag 10 may be tubular in shape, as shown in FIGS. 2 and 3, and preferably is constructed in two sizes, a "regular size" and a "heavy duty" size. A "regular" size bag is constructed of flexible sheet material, preferably of eighteen ounce vinyl, and is twenty inches in length and nine and one-half inches in diameter. This bag holds up to two hundred sixty pounds of weights 21 (shown schematically in FIG. 5). Weights are provided preferably in five to ten pound increments. The seams 15 of ends 14 of the weight bag are double stitched for the purposes of support and durability. The bags are sewn together with a strong nylon thread.

Figure 4:
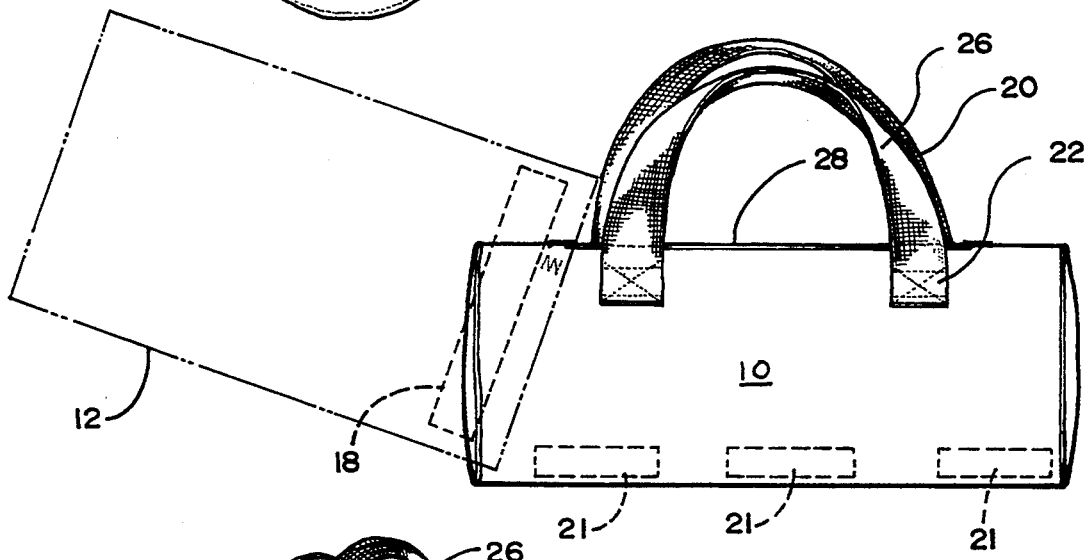
FIG. 4 is a front elevational view showing the position of the handles on the weight bag.

A pair of nylon loop handles 20 and 26, preferably two inches wide, are stitched to the top center of the weight bag as shown in FIGS. 3 and 4. The ends of each handle are sewn about seven inches apart to the weight bag by a secure X-shaped stitching pattern 22 as shown in FIG. 4. Centrally located on the top of the weight bag between the two handles is an opening 28, preferably fifteen inches in length which allows the user to insert or remove individual weights.

An alternative "heavy duty" bag also is constructed of flexible sheet material, preferably twenty-two ounce vinyl, and is twenty inches long and fourteen inches in diameter. The heavy duty bag holds up to five hundred pounds of weights, which preferably are provided in twenty-five pound increments. The ends of the bag are double stitched but are also reinforced with a two inch nylon strap over the seams. The handles are two inch nylon straps attached in the same manner as the regular bag, with the exception that a piece of two inch wide nylon strap is sewn over the ends of the handles to reinforce them. The weight opening is fifteen inches long, as in the regular bag.

Figure 5:
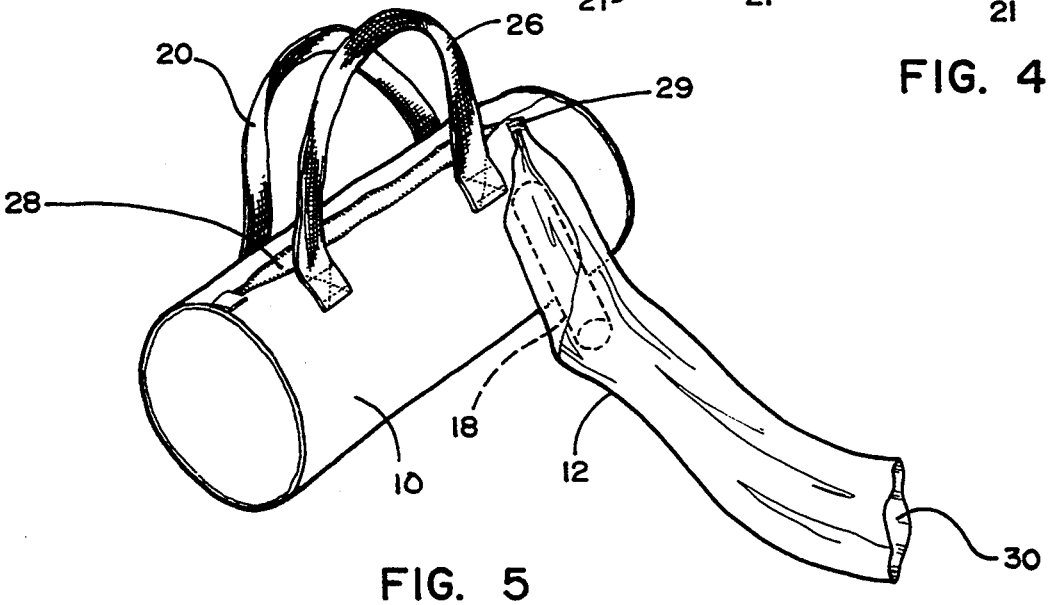
FIG. 5 is a perspective view showing the attachment of the shoulder bag to the weight bag and the opening on the weight bag.

Shoulder bag 12 shown in FIG. 3 is elongated and tubular and is preferably made of flexible thirteen ounce waterproof canvas. The shoulder bag is forty-six inches in length as shown in FIG. 5. The bag has a closed first end 17 which is attached to the weight bag at the corner 29 (see FIGS. 3 and 5). The bag also has an open second end 30. The interior has an opening fifteen inches in length by twenty inches in width. Said opening allows for the insertion therein of a transverse tubular rod 18, which preferably is a solid piece of wood which is fourteen inches in length by three and one-half inches in diameter. When the muscle building device is in use, the rod bears against the closed end of the shoulder bag and extends parallel to the top center of the weight bag beneath loop handles 20 and 26, so that the wood piece engages the overlapping handles and supports the weight of the bag, as shown in FIGS. 2 and 3.

When the weight building device is in use, the first end of the shoulder bag loops through weight bag handles 20 and 26, with the rod and first end of the shoulder bag being positioned on an inner side of the handle and the second end of the shoulder bag extending outwardly from an outer side of the handles. The shoulder bag is sufficiently long so as to provide a means for the user to carry the weight bag over the shoulder. The shoulder bag also holds the weight bag closed when it is carried over the shoulder of the user.

The foregoing is representative of the preferred construction of the present invention. Various modifications may be made in the practice of the present invention without departing from the spirit of the invention, which is defined in the appended claims.

I claim:

1. A mobile, variable weight device for muscle building exercise comprising:

a weight bag formed of flexible sheet material having a weight opening therein and a pair of loop handles at the top thereof for carrying the bag, the loop handles being deflectable so they overlap and form a shoulder bag opening therethrough;

a shoulder bag comprising an elongated bag made of flexible material having a closed first end and an open second end, the shoulder bag fitting through the shoulder bag opening between the loop handles;

fastening means for attaching the shoulder bag to the weight bag, said fastening means including a transverse rod being positioned in the shoulder bag adjacent to the closed end of the shoulder bag and extending transversely to the axis end of the bag, the transverse rod being positioned on an inner side of the loop handles and the second end of the bag being positioned on an outer side of the loop handles, the rod being longer than the shoulder bag opening such that the rod engages the loop handles and suspends the weight bag from the shoulder bag when the user carries the device by grasping the shoulder bag on the outer side of the loop handles; and a plurality of weights contained in the weight bag, the weights being inserted and removed through the opening in the weight bag.

2. A weight device as defined in claim 1, wherein the weight bag is constructed of eighteen ounce vinyl and is of tubular construction, the bag being about twenty inches long and about nine and one-half inches in diameter.

3. A weight device as defined in claim 1, wherein the weight bag is constructed of twenty-two ounce vinyl and is of tubular construction, the bag being about twenty inches long and about fourteen inches in diameter.

4. A weight device as defined in claim 1, wherein the loop handles are constructed of a flexible material and are centrally positioned adjacent to one another on the top of the weight bag, the weight opening being an elongated opening positioned between the loop handles.

5. A weight device as defined in claim 1, wherein the shoulder bag is removable from the handles so that the weight bag handles are separable, enabling the weight bag to be opened and the weights to be removed or inserted.

6. A mobile, variable weight device as defined in claim 1, wherein the weight bag is a horizontally disposed tubular bag made of flexible material, the bag having closed ends and the opening being an elongated, axially extending slot in the top of the bag.

* * * * *